US005525286A

United States Patent [19]

Bornmann et al.

[11] Patent Number: 5,525,286

[45] Date of Patent: Jun. 11, 1996

[54] PROCESS FOR CONTROLLING THE ANISOTROPY OF SPUNBONDED WEBS

[75] Inventors: Uwe Bornmann; Manfred Winkler; Heinz Schörgenhuber, all of Linz, Austria

[73] Assignee: Polyfelt Gesellschaft m.b.H., Linz, Austria

[21] Appl. No.: 292,781

[22] Filed: Aug. 18, 1994

[30] Foreign Application Priority Data

Aug. 19, 1993 [AT] Austria ..... 1660/93

[51] Int. Cl.[6] ..... D01D 5/088; D01D 5/098; D01D 7/00; D01D 10/00

[52] U.S. Cl. ..... 264/444; 264/210.8; 264/211.15; 264/555

[58] Field of Search ..... 264/23, 69, 210.8, 264/211.14, 211.15, 555, 444

[56] References Cited

U.S. PATENT DOCUMENTS 3,853,651 12/1974 Porte ..... 156/73.6
4,163,305 8/1979 Semjonow et al. ..... 19/299
4,497,097 2/1985 Schneider et al. ..... 28/112

FOREIGN PATENT DOCUMENTS 1292548 4/1969 Germany .
2460755 7/1976 Germany .
2526364 12/1976 Germany .
2204886 11/1988 United Kingdom .

OTHER PUBLICATIONS

L. Gerking, "Vliesstruktur und Vlieslegung bei Spinnvliesstoffen", Chemiefasern/Textilindustrie, 37./89. Jahrgang, pp. 698–701 (Aug. 1987).

*Primary Examiner*—Leo B. Tentoni
*Attorney, Agent, or Firm*—Wenderoth, Lind & Ponack

[57] ABSTRACT

Process for controlling the anisotropy of the mechanical properties of spunbonded webs through variation of the frequency of vibration of impingement panels at web laydown.

3 Claims, No Drawings

PROCESS FOR CONTROLLING THE ANISOTROPY OF SPUNBONDED WEBS

FIELD OF THE INVENTION

The invention relates to a process for the specific control of the anisotropy of the mechanical properties of spunbonded webs with the aid of vibrating impingement panels and to the use of vibrating impingement panels for the specific control of the anisotropy of the mechanical properties of spunbonded webs in the longitudinal and transverse directions.

DESCRIPTION OF PRIOR ART

As is known, for example from U.S. Pat. No. 4,497,097 or U.S. Pat. No. 3,853,651, spunbonded webs can be produced by extrusion of liquid melts of thermoplastics, for example polyolefins, polyesters or polyamides, through multiple hole dies, pulldown, cooling and drawing, for example by means of drawing air, and laydown of the resulting continuous filaments on a transporting belt in the form of a random web. These webs may, if desired, be subsequently consolidated, for example by needling. The webs obtained usually have different mechanical properties in the longitudinal (L) and transverse (T) directions, for example different strengths or extensibilities, which result as a function of the process parameters and the type of web. A substantially isotropic behavior of the properties, i.e., very similar values in the longitudinal and transverse directions, as usually desired with the existing spunbonded web processes, is obtained for example in U.S. Pat. No. 4,497,097 by subsequent drawing of the webs and in U.S. Pat. No. 3,853,651 by using a vibrating impingement panel in the laydown of the filaments on the transporting belt. In this process, according to U.S. Pat. No. 3,853,651, the frequency of vibration has no bearing on the achievement of isotropy, i.e., an L/T ratio of 1, since frequencies from 1.6 to 1000 Hz (16.6 and 33.3 Hz according to the examples) will allegedly always produce an isotropic strength distribution.

However, to obtain optimum web quality for certain fields of use or to optimise the web production process, it is in many cases necessary to obtain a very specific anisotropy in respect of the web properties. For instance, if webs are transversely stretched as in U.S. Pat. No. 4,497,097 it is necessary to have webs which, from the process conditions or the constitution of the webs, for example the web weight, the material of the filaments, the stretch ratio, the stretching speed, the stretching temperature, have an about 10 to 80% higher strength in the longitudinal direction than in the transverse direction. This case accordingly requires a very specific anisotropy ratio of the strength in the longitudinal direction (L) to the strength in the transverse direction (T) corresponding to an L/T ratio from about 1.1:1 to 1.8:1.

SUMMARY OF THE INVENTION

Surprisingly, it has now been found that the anisotropy of the web properties in the longitudinal and transverse directions can be controlled in a very accurate, specific and defined manner through variation of the frequency of vibration of the impingement panels during the laydown of the filaments. This was particularly surprising since it was known, for example from U.S. Pat. No. 3,853,651 that in the case of isotropic webs the frequency of vibration has apparently no bearing on the L/T ratio (in this case 1:1).

The present invention accordingly provides a process for the specific control of the anisotropy of the mechanical properties in the longitudinal (L) and transverse (T) directions of spunbonded webs consisting of thermoplastic filaments wherein the filaments extruded by the spinneret are cooled, drawn and laid by means of a vibrating impingement panel down on a transporting belt to form a random web, which process is characterized in that the frequency of vibration of the impingement panel is varied as a function of the desired ratio of the anisotropy.

DETAILED DESCRIPTION OF THE INVENTION

To produce the spunbonded webs it is possible to use any thermoplastically processible plastics, for example polyolefins, polyesters or polyamides, particular preference being given to polyolefins and polyesters.

The frequency of vibration of the impingement panel depends on the desired L/T ratio of the web properties and preferably ranges from about 10 to 100 Hz. The frequency of vibration is particularly preferably set Go such a value that, irrespective of the properties of the starting web, an L/T ratio is obtained for the web strength (measured as strip tensile strength in accordance with DIN 53857/2) within the range from 1.1:1 to 1.8:1, particularly preferably from 1.1:1 to 1.5:1.

The invention further provides for the use of vibrating impingement panels which, in an apparatus for producing spunbonded webs consisting of thermoplastic filaments, lay the thermoplastic filaments extruded by the spinneret, and then cooled and drawn, down on a transporting belt, for the specific control of the anisotropy of the mechanical properties of the spunbonded webs in the longitudinal and transverse directions through variation of the frequency of vibration of the impingement panels.

The impingement panels are disposed at an angle from about 100° to 170° relative to the pulldown direction of the filaments and vibrate up and down at frequencies of preferably 10 to 100 Hz. It is preferred to construct the impingement panels in such a way that they are rigid in the upper region, in which the filaments impinge, and only vibrate in the lower part. The vibration of the impingement panels is produced by customary methods, for example by means of cams, mechanically, electrically, magnetically or pneumatically. It is further possible that, in addition to the up and down vibration, the impingement panels also traverse left and right, in which case the traversing frequency ranges from about 0.2 to 5 Hz.

Suitable materials for the impingement panels are in particular metals, for example steel, ceramics, glass, graphite or plastics, preferably high performance plastics, for example aromatic polyamides, polyimides, polysulfones, polyether ketones, polyether imides, polyesters, epoxides, melamine resins or phenolic resins. Especially in the case of the use of relatively high frequencies of vibration from about 30 to 40 Hz (vibrations per sec) it is preferable to use fiber-reinforced plastics or graphites at least for the vibrating part of the impingement panels. Suitable reinforcing fibers include for example glass, carbon, ceramic or aramid fibers.

Example 1

A laboratory spinning range was used at a throughput of 180 kg/h to produce filaments from polypropylene homopolymer having an MFI (melt flow index according to DIN 53735 at 230° C./2.16 kg) of about 20 g/10 min (Daplen PT 551) by melting at 230° C., extruding through a spinneret having 1500 capillaries, cooling, drawing via 3 pneumatic pulldown systems, and laying down by means of 3 vibrating impingement panels on a transporting belt as a 100 cm wide web having a basis weight of 100 g/m$^2$ at a production speed of 24 m/min. The impingement panels were made of carbon fiber reinforced polyether ether ketones, the length of the vibrating part was 100 mm, the width at the lower edge was 200 mm. The frequency of vibration of the impingement panels was continuously variable within the range from 0 to 100 Hz. The frequency of vibration was set to 30 Hz. The amplitude of vibration was about 15 mm, the inclination of the impingement panels relative to the direction of pulldown was about 120°.

The web obtained had a strength, measured in accordance with DIN 53857/2, of 293 N in the longitudinal direction and of 210 N in the transverse direction, corresponding to an L/T ratio of 1.4:1.

Example 2

Example 1 was repeated with the basis weights and impingement panel vibration frequencies listed in Table 1. The L/T ratios obtained in each case for the web strengths are likewise summarized in Table 1.

Example 3

To demonstrate the control of the L/T ratio of the web strength through variation of the frequency of vibration of the impingement panels, webs having a basis weight of 400 g/m$^2$ and 700 g/m$^2$ were produced analogously to Examples 1 and 2 with the frequencies of vibration indicated in Table 2. The L/T ratios of the strengths are likewise summarized in Table 2.

TABLE 1

| basic weight (g/m$^2$) | frequency (Hz) | L/T-ratio |
|---|---|---|
| 100 | 30 | 1.4:1 |
| 200 | 32 | 1.4:1 |
| 300 | 37 | 1.4:1 |
| 400 | 42 | 1.4:1 |
| 500 | 45 | 1.4:1 |
| 700 | 48 | 1.3:1 |

TABLE 1-continued

| basic weight (g/m$^2$) | frequency (Hz) | L/T-ratio |
|---|---|---|
| 900 | 50 | 1.3:1 |
| 1200 | 53 | 1.3:1 |

TABLE 2

| frequency (Hz) | L/T-ratio |
|---|---|
| basis weight: 400 g/m$^2$ | |
| 25 | 1.1:1 |
| 33 | 1.2:1 |
| 38 | 1.3:1 |
| 43 | 1.4:1 |
| 48 | 1.5:1 |
| basis weight: 700 g/m$^2$ | |
| 25 | 0.9:1 |
| 38 | 1.1:1 |
| 43 | 1.2:1 |
| 48 | 1.3:1 |

What we claim is:

1. In a process for the manufacture of spunbonded webs consisting of thermoplastic filaments in which the filaments are extruded by a spinneret, then are cooled, drawn and laid down, by means of a vibrating impingement panel, on a transporting belt to form a random spunbonded web, the improvement which comprises varying the frequency of vibration of the impingement panel, whereby the anisotropy of the mechanical properties in the longitudinal (L) and transverse (T) directions of said web is controllably varied, to produce a web with substantial anisotropic mechanical properties in the L and T directions.

2. The process according to claim 1, wherein the frequency of vibration of the impingement panel is in the range from 10 to 100 Hz.

3. The process according to claim 1, wherein the anisotropy of the mechanical properties, measured as the L/T ratio of the strengths of the web, ranges from 1.1:1 to 1.8:1.

* * * * *